US005170608A

United States Patent [19]

Petry et al.

[11] Patent Number: 5,170,608

[45] Date of Patent: Dec. 15, 1992

[54] DEVICE FOR CLOSING A PACKAGE PROVIDED WITH AT LEAST ONE FLAP

[75] Inventors: Martin Petry, Giessen; Ralf Görsdorf, Biebertal, both of Fed. Rep. of Germany

[73] Assignee: Rovema Verpackungsmaschinen GmbH, Fernwald, Fed. Rep. of Germany

[21] Appl. No.: 665,568

[22] Filed: Mar. 6, 1991

[30] Foreign Application Priority Data

Mar. 8, 1990 [DE] Fed. Rep. of Germany ... 9002694[U]

[51] Int. Cl.[5] ..... B65B 7/16

[52] U.S. Cl. ..... 53/377.2; 53/378.3

[58] Field of Search ..... 53/371.4, 374.4, 376.2, 53/376.7, 377.2, 377.8, 378.3, 387.2; 493/178, 179, 183

[56] References Cited

U.S. PATENT DOCUMENTS

| | | | |
|---|---|---|---|
| 1,912,565 | 6/1933 | Brown | 493/183 X |
| 2,116,607 | 5/1938 | Milmoe | 53/377.2 X |
| 2,390,120 | 12/1945 | Peters | 493/178 X |
| 3,389,645 | 6/1968 | Winters et al. | 53/376.7 X |
| 3,535,987 | 10/1970 | Schafer et al. | 53/376.7 X |
| 3,619,977 | 11/1971 | Theys et al. | 53/376.7 |
| 3,713,952 | 1/1973 | Schafer et al. | 53/376.7 X |
| 4,144,800 | 3/1979 | Hughes | 493/178 X |
| 4,206,579 | 6/1980 | Woxland | 53/377.2 X |
| 4,435,943 | 3/1984 | Hoyrup | 53/377.2 X |

*Primary Examiner*—John Sipos
*Assistant Examiner*—Daniel B. Moon
*Attorney, Agent, or Firm*—Flynn, Thiel, Boutell & Tanis

[57] ABSTRACT

The invention relates to a device for closing a package (1) provided with at least one flap (2), comprising a path of movement for the package (1) and comprising a rotatable closing element (3) arranged next to the path of movement. In order to prevent the package from being deformed during closing of the flap (2) and in order to be able to carry out the closing operation quickly and safely, it is provided that the closing element is designed in the form of a cylindrical pipe, at least at one area of its outer surface being cut at an angle in order to define a guide edge (4).

9 Claims, 1 Drawing Sheet

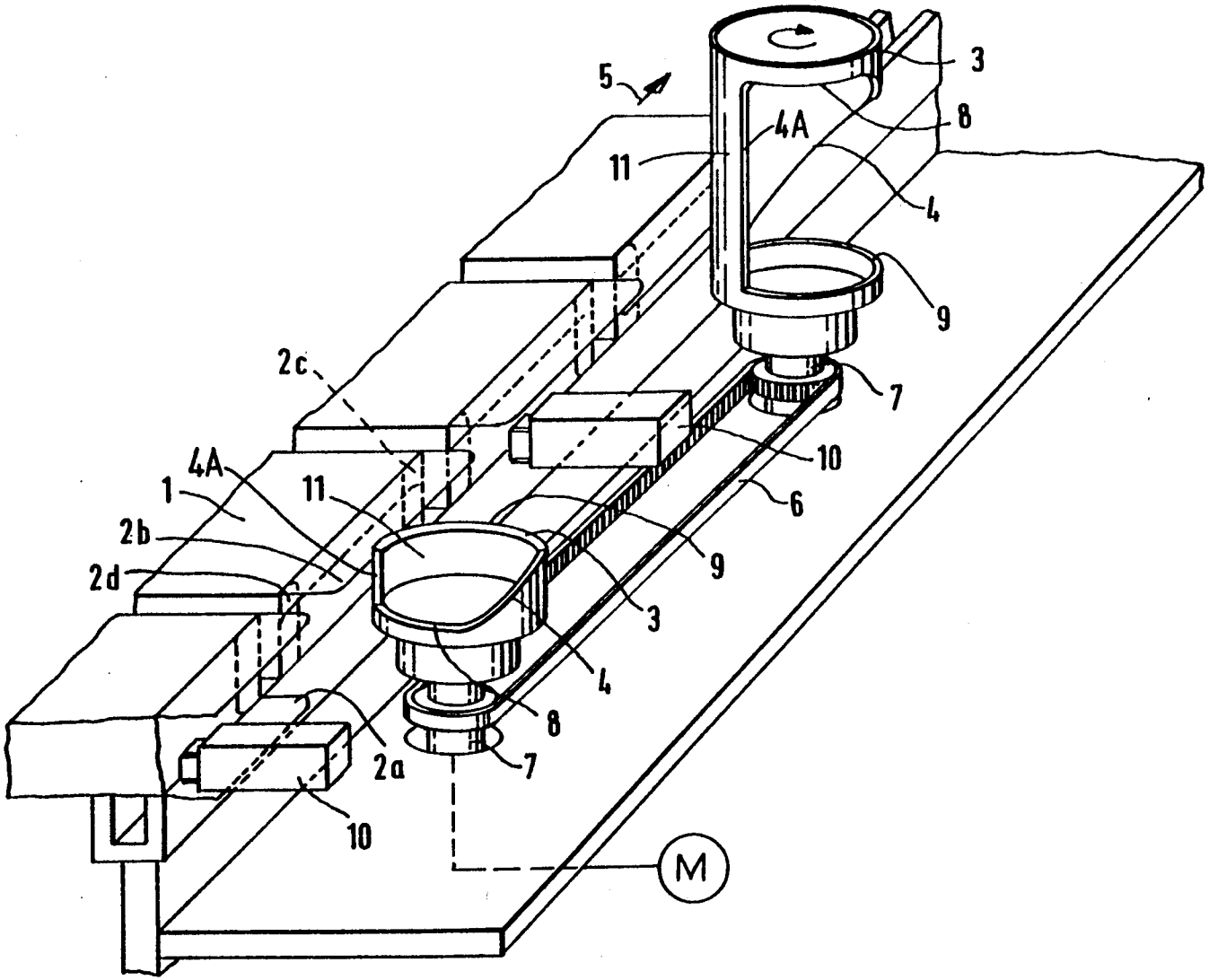
3
8
4
9
7
10
6
4A
5
11
9
3
4
8
7
M
2a
10
2c
11
4A
1
2b
2d

DEVICE FOR CLOSING A PACKAGE PROVIDED WITH AT LEAST ONE FLAP

FIELD OF THE INVENTION

The invention relates to a device for closing of a package having at least one flap, comprising a path of movement for the package and comprising a rotatable closing element arranged next to the path of movement.

BACKGROUND OF THE INVENTION

In order to package articles in folded packages, it is necessary to erect the package from a flat transporting condition in order to be able to move the article to be packaged into the inside of the package. The packages are thereby usually lying side-by-side on a path of movement such that the article can be moved into the package from the end thereof. To close the package, it is subsequently necessary to fold one or several flaps in order to thereafter facilitate a gluing of these flaps together.

According to the system, the folding of the flap must occur while the package is being transported along the path of movement.

It is known from the state of the art to fold the respective flap by means of a guide or a wedge-shaped rail. Such a device is known from U.S. Pat. No. 4,056,046. This reference shows a device for folding and gluing a folded package. A flat, punched-out blank is thereby guided along a path of movement. The side or flap of the blank to be folded is lifted by means of a key and is thereafter completely bent by a closing element. This technique for closing of folded packages has the disadvantage that a frictional force occurs at all times between the package and the corresponding closing element, which frictional force is parallel to the direction of movement of the package. This frictional force effects a slowing down of the respective flap area of the package, which in turn has the result that the package as a whole is being deformed. A parallelepipedon shape of the package results after the closing, which is undesired since not only the aesthetic appearance suffers but the package can also not be sufficiently further processed. This disadvantage cannot be avoided with the known devices, since the package is unstable in the not closed condition and will be deformed already as a result of small frictional forces.

SUMMARY OF THE INVENTION

The basic purpose of the invention is to provide a device of the above-mentioned type, which with a simple design and a reliable operation enables the closing of a package having at least one flap such that deformations of the package are impossible.

The purpose is attained according to the invention by the closing element being designed in the form of a cylindrical pipe, at least at one area of its outer surface being cut at an angle in order to define a guide edge.

The device of the invention is distinguished by a number of significant advantages. The cylindricalpipelike closing element has a guide edge surface which, upon a rotation of the closing element and a movement of the package along the path of movement, rolls with a substantially punctiform contact surface along the flap of the package so that substantially no frictional forces, in particular, however, no frictional forces in direction of the path of movement occur. With this a deformation of the unstable, not yet closed package is completely avoided.

The guide edge surface, which is designed substantially elliptically, grips thus upon a rotation of the closing element of the invention with its lowermost or uppermost area under the flap and lifts same up upon a forward movement of the package and a further rotation of the closing element so that the flap is folded and is bent substantially at 90°. Upon a further rotation of the closing element and a forward movement of the package, the uncut portion of the outer surface, into which the guide edge surface transfers, presses against the flap so that same can be glued to other parts of the package.

The speed of rotation of the closing element and the speed of the package along the path of movement are preferably the same so that a closing of the flap is obtained through the shearing forces applied to the package. A deformation of the package through frictional forces which act parallel with respect to the direction of movement of the package is thus impossible.

A particularly favorable further development of the invention provides that the cut of the cylindrical pipe is in the form of a substantially planar surface. The ellipse thus achieved enables a smooth sequence of movement during closing of the flap without causing the occurrence of sudden impacts or strong accelerations to be applied to the flap.

It is possible according to the invention to construct the cut of the cylindrical pipe along the entire peripheral area, however, the cut can also exist over a partial area of the circumference of the cylindrical pipe. The length of the peripheral area which has the guide edge determines the folding speed of the flap and the time duration during which the flap is held in the closed position by the closing element.

In order to be able to adjust the device of the invention in a particularly simple manner to different formats, in particular different heights of packages, the closing element is preferably designed to be elevationally adjustable. The elevational adjustment can thereby be carried out as a presetting, however, it is also possible to move the closing element simultaneously up and down during its rotation.

The circumference of the cylindrical pipe corresponds substantially with the length of the package in direction of the path of movement since it is assured in this manner that the closing element is again in the initial position during the approach of the next package.

In order to be able to keep the flap, after it has been folded into its closed position, in this position and in order to be able to press on it, it is provided that the outer surface of the cylindrical pipe is arranged to engage the surface formed when the package is closed.

Since a folded package has usually several flaps, normally four flaps each, at the bottom and also the top area, the device of the invention can have preferably several closing elements, usually one separate closing element is provided for each flap.

The cylindrical-pipelike closing element can be driven according to the invention by the closing element being connected to a drive mechanism for moving the package or rather for driving the entire packaging machine. However, it is also possible to provide the closing element with a separate, controllable drive, which also results in the advantage that during a standstill of the system, the flap can be completely closed.

Thus, the invention makes it possible to close the flap of a package in such a manner that the entire package is practically not deformed since the occurring frictional force is aligned substantially only perpendicularly with respect to the direction of movement of the package. Furthermore, a special advantage of the device of the invention is that the design of the closing element is independent from the conveying speed of the packages since the speed of rotation of the closing element can be increased as desired upon a higher speed of movement of the packages. Thus, the device can be utilized universally for many different purposes.

BRIEF DESCRIPTION OF THE DRAWINGS

The invention will be described hereinafter in connection with one exemplary embodiment and the drawing, which drawing is a partially perspective, schematic view of the device of the invention.

DETAILED DESCRIPTION

The drawing shows several folded packages 1 which are moved along a path of movement. The direction of movement of the packages 1 is shown by the arrow 5. The folded packages consist each of four connected sidewalls and are arranged on the path of movement such that a filling from the end of the open bottom or rather top areas of the package 1 is possible. The filling is done in a conventional manner and is therefore not illustrated in detail.

The packages 1 have a total of four flaps at the end area shown in FIG. 1, namely one upper flap **2*b*, one lower flap 2*a* and on the side smaller flaps 2*c* and 2*d***.

The lateral flaps **2*c* and 2*d*** have already been folded into the closed condition in the operating condition shown in the drawing.

The device of the invention has a closing element 3 in the form of a hollow cylindrical pipe. A portion of the thin wall of the cylindrical pipe 3 is cut so that an edge of the cut thin wall defines a guide edge surface 4.

A total of two closing elements 3 exist in the device illustrated in the drawing, which closing elements are connected with one another through a toothed belt 6 so that the two closing elements 3 can be rotated synchronously to one another. The closing elements 3 are each rotatably supported on a frame by means of a shaft 7 in a not illustrated manner. The shaft 7 is connected to a further drive mechanism m.

The guide edge surface 4 extends in the illustrated exemplary embodiment over a portion of the periphery of the closing element, with the guide edge surface 4 transferring in particular rising from or rather dropping off from a horizontal edge surface 8 (depending on the alignment of the closing element 3) into a further horizontal edge surface 9. The distance between the two edge surfaces 8, 9 results from the type of installation of the closing elements and the distance between the flaps to be closed. In the case of the closing element illustrated at the lower left of the drawing, the lower flap **2*a* is first closed. The height of the edge surface 8, referred to the path of movement of the package 1, is thus chosen such that the edge surface 8 becomes coextensively arranged with and below the lower flap 2*a* which is not yet folded and in spaced parallel planes extending perpendicular to an axis of rotation of the closing element 3. Upon a rotation of the closing element 3 (in clockwise direction) the lower flap 2*a* thus eventually engages the guide edge surface 4 and is pressed upwardly by the guide edge. After reaching an angle of rotation corresponding with the guide edge surface 4, the flap 2*a*, which is now folded upwardly, is thus held in the erect position by the remaining cylindrical wall area of the closing element 3. The lower flap 2*a* is in this position glued to the already folded flaps 2*c* and 2*d*. The adhesive material needed to do this is applied by an adhesive-material nozzle 10 (only schematically illustrated) prior to the folding operation of the lower flap 2*a*. The edge surfaces 4, 8 and 9 as well as a further edge surface 4A are all oriented within the confines of the outer circumference of the closing element 3**.

As can furthermore be seen in the drawing, a further adhesive-material nozzle 10 is arranged after the first closing element 3. Adhesive material from the further nozzle can be applied onto the outside of the already folded flap **2*a*. The package 1 is subsequently fed to the closing element 3 shown in the right upper part of the drawing so that the upper flap 2*b* can be folded downwardly by the guide edge surface 4. The drawing illustrates the operating condition in which the folding operation has already occurred and in which, with the help of the uncut portion of the outer surface of the cylindrical jacket 11, the flap 2*b* is pressed against the flap 2*a*** to complete the gluing operation.

The circumference of the closing elements 3 corresponds substantially with the length of the package 1, referred to the direction of movement, and the design of the guide edge surface 4 depends on the respective conditions and can be widely varied.

The invention is not to be limited to the illustrated exemplary embodiment, rather many modification possibilities exist for the man skilled in the art within the scope of the invention.

The embodiments of the invention in which an exclusive property or privilege is claimed are defined as follows:

1. In a device for closing a package, the package being provided with at least one planar flap, said device including means for providing a path of movement for the package and a rotatable closing element arranged next to the path of movement for engaging and closing the slap, the improvement wherein the closing element is a thin wall cylindrical pipe, said thin wall being uniformly thick throughout a length thereof, at least one area of the thin wall being cut away so that plural edge surfaces of the thin wall are exposed, a first one of the exposed edge surfaces facing in an axial direction of said cylindrical pipe and oriented in a plane extending perpendicular to an axis of rotation of said pipe, a second one f the exposed edge surfaces also facing in the same direction as said first edge surface and being contiguous with and inclined at an angle relative to said first edge surface, each of said first and second edge surfaces being oriented radially inside of an outer circumference of said pipe, and support means for supporting said pipe and said first edge surface and the flap on the package in spaced parallel planes extending perpendicular to the axis of rotation of said pipe, whereby the axially facing first edge surface and an initial position of the flap on the package become overlappingly oriented in said spaced parallel planes extending perpendicular to the axis of rotation of said pipe due to a rotation of said pipe, said inclined second edge surface, at a juncture between said first and second edge surfaces, engaging a leading end of the flap to urge the leading end of the flap perpendicular to the plane of the flap as said inclined second edge surface is moved about said axis of rotation and the package and flap are moved along the path of movement, a portion of the outer circumference of said pipe mutually adjacent said second edge surface eventually engaging the flap to continue to urge a remainder of the flap perpendicular to the plane of the flap and hold the flap folded with respect to the package.

2. The device according to claim 1, wherein several closing elements are provided for closing several flaps on the package.

3. The device according to claim 1, wherein several closing elements are provided for closing several flaps on the package.

4. The device according to claim 1, wherein the closing element is operatively connected to a drive mechanism.

5. The device according to claim 4, wherein said drive mechanism rotates the closing element so that a peripheral speed of the closing element equals a speed of the package along the path of movement.

6. The device according to claim 1, wherein a length of said cylindrical pipe is less than a spacing between two parallel extending flaps on the package.

7. The device according to claim 6, wherein one axial end of said cylindrical pipe includes a third edge surface extending parallel to said first edge surface; and wherein said first and third edge surfaces extend in respective and spaced parallel planes facing in the same direction, said second edge surface being contiguous to both of said first and third edge surfaces.

8. The device according to claim 1, wherein a length of said cylindrical pipe is greater than a spacing between two parallel extending flaps on the package;

wherein said cylindrical pipe has a third edge surface radially inside said outer circumference of said pipe and extending parallel to said first edge surface; and wherein said first and third edge surfaces extend in respective and spaced, mutually facing, parallel planes perpendicular to the axis of rotation of said pipe, said second edge surface being contiguous with both of said first and third edge surfaces.

9. The device according to claim 8, wherein a fourth edge surface, circumferentially spaced form said second edge surface, is contiguous with said first and third edge surface, said fourth edge surface also being radially inside of said outer circumference of said pipe.

* * * * *

UNITED STATES PATENT AND TRADEMARK OFFICE

CERTIFICATE OF CORRECTION

PATENT NO. : 5,170,608

DATED : December 15, 1992

INVENTOR(S) : Martin PETRY et al

It is certified that error appears in the above-identified patent and that said Letters Patent is hereby corrected as shown below:

Column 4, line 42; change "slap" to ---flap---.
line 50; change "f" to ---of---.

Column 5, lines 7, 8 and 9 delete in their entirety and replace with the following text:

2. The device according to Claim 1, wherein a circumference of the cylindrical pipe equals substantially a length of the package in direction of the path of movement.

Column 6, line 22; change "form" to ---from---.

Signed and Sealed this

Eighth Day of February, 1994

Bruce Lehman

*Attest:*

BRUCE LEHMAN

*Attesting Officer*

*Commissioner of Patents and Trademarks*